US006668733B1

(12) United States Patent
Martens et al.

(10) Patent No.: US 6,668,733 B1
(45) Date of Patent: Dec. 30, 2003

(54) FLOOR FOR VEHICLES, IN PARTICULAR, RAIL VEHICLES FOR TRANSPORTING PASSENGERS

(75) Inventors: Holger Martens, Berlin (DE); Gerald Erler, Birkenwerder (DE)

(73) Assignee: Bombardier Transportation GmbH, Berlin (DE)

( * ) Notice: Subject to any disclaimer, the term of this patent is extended or adjusted under 35 U.S.C. 154(b) by 0 days.

(21) Appl. No.: 10/018,013

(22) PCT Filed: Jun. 6, 2000

(86) PCT No.: PCT/EP00/05187

§ 371 (c)(1),
(2), (4) Date: May 9, 2002

(87) PCT Pub. No.: WO00/76822

PCT Pub. Date: Dec. 21, 2000

(30) Foreign Application Priority Data

Jun. 9, 1999 (DE) ..... 199 27 006

(51) Int. Cl.[7] ..... B61D 17/10
(52) U.S. Cl. ..... 105/422
(58) Field of Search ..... 105/422, 452, 105/238.1, 329.1, 396, 397

(56) References Cited

U.S. PATENT DOCUMENTS 5,339,745 A * 8/1994 Ritzl et al. ..... 105/452

FOREIGN PATENT DOCUMENTS

| | | | | |
|---|---|---|---|---|
| DE | 26 00 827 A | | 7/1977 | |
| DE | 2600827 | * | 7/1977 | ..... E04B/1/60 |
| DE | 44 41 290 C1 | | 4/1996 | |
| EP | 0 576 394 A1 | | 12/1993 | |
| EP | 0622286 A1 | * | 4/1994 | ..... B61D/17/18 |
| EP | 0 622 286 A | | 11/1994 | |
| WO | WO 98 09860 A | | 3/1998 | |

* cited by examiner

*Primary Examiner*—S. Joseph Morano
*Assistant Examiner*—Robert J. McCarry, Jr.
(74) *Attorney, Agent, or Firm*—Webb Ziesenheim Logsdon Orkin & Hanson, P.C.

(57) ABSTRACT

The invention aims to improve a floor for rail vehicles in such a way that an even, level, reference plane for constructing the floor is obtained by a simple tolerance compensation of the deviations in the longitudinal direction, transverse direction and height of the shell assembly. Said compensation is embodied as an easy-to-assemble positive-fit connection between the floor plate and the body-shell floor plate. This is achieved by a retaining profile which is configured as a profile with a recess for accommodating a connecting element and provided with at least one blind opening. An elastic spacer, comprising a plug-in extension to compensate for the existing differences in level between the floor plate and the floor-profile plate, is inserted into the blind opening under pressure, forming a positive-fit. The positive-fit between the blind opening and the plug-in extension is perpendicular in relation to the positive-fit between the profile batten and the retaining profile.

11 Claims, 4 Drawing Sheets

FLOOR FOR VEHICLES, IN PARTICULAR, RAIL VEHICLES FOR TRANSPORTING PASSENGERS

This invention relates to a floor for vehicles, in particular railway vehicles for transporting passengers, with a rigid bottom profile plate on which profile battens that are elastic in the longitudinal direction and have recesses are clamped as an isolation profile in projecting retaining webs so that they can move in the longitudinal direction, whereby a rigid retaining profile is fixed in the recesses so that it can move longitudinally, and with floor plates that are laid in the transverse direction with respect to the longitudinal direction of the vehicle, whereby the transverse edges of the floor plates are connected to one another.

EP 0 622 286 B1 describes an acoustically insulating support element for cover bodies, in particular for the formation of floors in railway vehicles for the transport of passengers, which consists of a rigid profile which is fastened to the support body or the cover body, which is elastically supported against the respective other body with the interposition of an insulating element. Fastened to the support or cover body is an elastic profile batten which has a recess in which a rigid hollow profile that is open toward the respective other body is fastened by a press fit, whereby projections of the rigid hollow profile are engaged in the recess of the elastic profile batten. A second rigid profile is fastened to the cover or support body, which has a web which is engaged in the open hollow profile and is elastically connected by means of an elastic insulating element with some separation with the rigid hollow profile, whereby the insulating material has physical characteristics such that it is capable of satisfactorily insulating higher frequencies. Between the rigid profile and the cover or support body, there is a compensating or equalizing layer which is made of an elastic material such as rubber, for example.

The profile batten of this support element of the prior art is of course installed so that it can move longitudinally, but a compensation for vertical tolerances to level the floor plate to a horizontal position can be accomplished only by the insertion of an equalizing shim which is made of elastic material. As a result of the variances caused by manufacturing tolerances that are encountered during the construction of the floor area, the vertical tolerances differ from support point to support point of the floor plate, which means that an individual equalization is possible only if these variances are measured during assembly and the equalizing shim is sized accordingly. This whole equalization process is very time consuming. Additional disadvantages of the support element of the prior art include the fact that the use of two rigid profiles connected by a PUR soft foam is labor intensive, relatively difficult and makes the finished structure quite thick, which has an adverse effect on the longitudinal displacement in the recesses of the profile batten on account of the lever effects caused by the forces that are applied at those points.

DE 44 41 290 C1 describes an elastically supported connecting element that acts as an acoustical and vibration damper for floors of railway vehicles for the transport of passengers, in particular for a two-shell, non-wooden floor that is manufactured in segments, whereby between the floor plate and the car body chassis, there are elastic intermediate elements that accept segmental adhesive connections and are oriented transverse to the car body chassis. The elastic connecting element consists of a profile body that lies transverse to the car body chassis and the longitudinal extension of which is determined by the side wall profiles of the car body, with an elastic support that is connected with a positive fit above and below the profile body on one hand and on the other of an elastic adhesive support that is applied in segments in the same direction underneath it on the car body chassis. Plate-shaped webs are set into profile bodies as bearings for the floor-mounted accessories such as seat frames, poles, partitions and air conditioning partitions.

In the longitudinal direction of the car body chassis, there are elastic spacer strips that are located to the left and right of the elastic adhesive support, which spacer strips create the space required for the adhesive connection between the profile body and the car body chassis and also form a leveled plane for the subsequent construction of the floor.

In this solution of the prior art, between the floor plate and the profile body that rests on the spacer strips, there is an elastic support that is made of rubber with elevations pointing toward the floor plate and depressions which must be sized differently to allow an equalization of vertical differences due to manufacturing tolerances.

This solution therefore does not eliminate the disadvantages described above. This solution of the prior art has the additional disadvantage that the bearings must be very precisely positioned in the transverse direction. The use of adhesive is also complex, time-consuming and expensive.

EP 0 576 394 A1 also describes an elastic connecting element that dampens vibrations and noise for the floating mounting of a floor structure on a supporting car bottom of railway vehicles and road vehicles for the transport of passengers with an elastic body with bearing surfaces for the car bottom and the floor superstructure. The connecting element has a base profile with a bearing surface for the car bottom and a cover profile that is vertically offset with respect to the base profile with a bearing surface for the floor superstructure, with stop surfaces that are arranged in pairs opposite each other and lie essentially perpendicular to the car bottom and floor superstructure, and an elastic mass that is located between the stop surfaces and is adhesively connected to them. On this connecting element of the prior art, although it dampens vibrations and noise, the process of making individual adjustments to equalize vertical manufacturing tolerances is complex, time-consuming and expensive.

The object of the invention is to improve a floor for railway vehicles so that a leveled, continuous reference plane can be established for the floor superstructure by a simple and easy equalization of the variances in the longitudinal and transverse direction caused by manufacturing tolerances, and in the vertical direction as a simple positive-fit connection between the floor plate and the car body bottom plate.

The invention teaches that this object can be accomplished with the characterizing features disclosed in claim 1. The dependent claims disclose advantageous developments of the invention.

The vertical equalization for tolerance variations is achieved by the insertion into the retaining profile, of elastic spacers with dimensions that are adapted to the vertical variance, the result of which is an easily leveled reference plane for the floor superstructure. The installation process is both easy and time-saving. The floor superstructure claimed by the invention is also characterized by the fact that its height and weight are low, and that nevertheless, excellent damping of noise and vibrations is achieved as a result of the different Shore hardness of the profile batten and spacer part.

Consequently, the advantages achieved by the invention are that the assembly times can be shortened, manufacturing costs can be reduced and an individual vertical equalization of the tolerance variances over the length and width of the car body becomes possible. The floor plate, which can be made of wood or aluminum, can thereby be fastened continuously and without changes in level to the bearings that are themselves leveled in a reference plane, while retaining the longitudinal displacement capability.

One exemplary embodiment of the invention is explained in greater detail below with reference to the accompanying drawings, in which.

Figure 1:
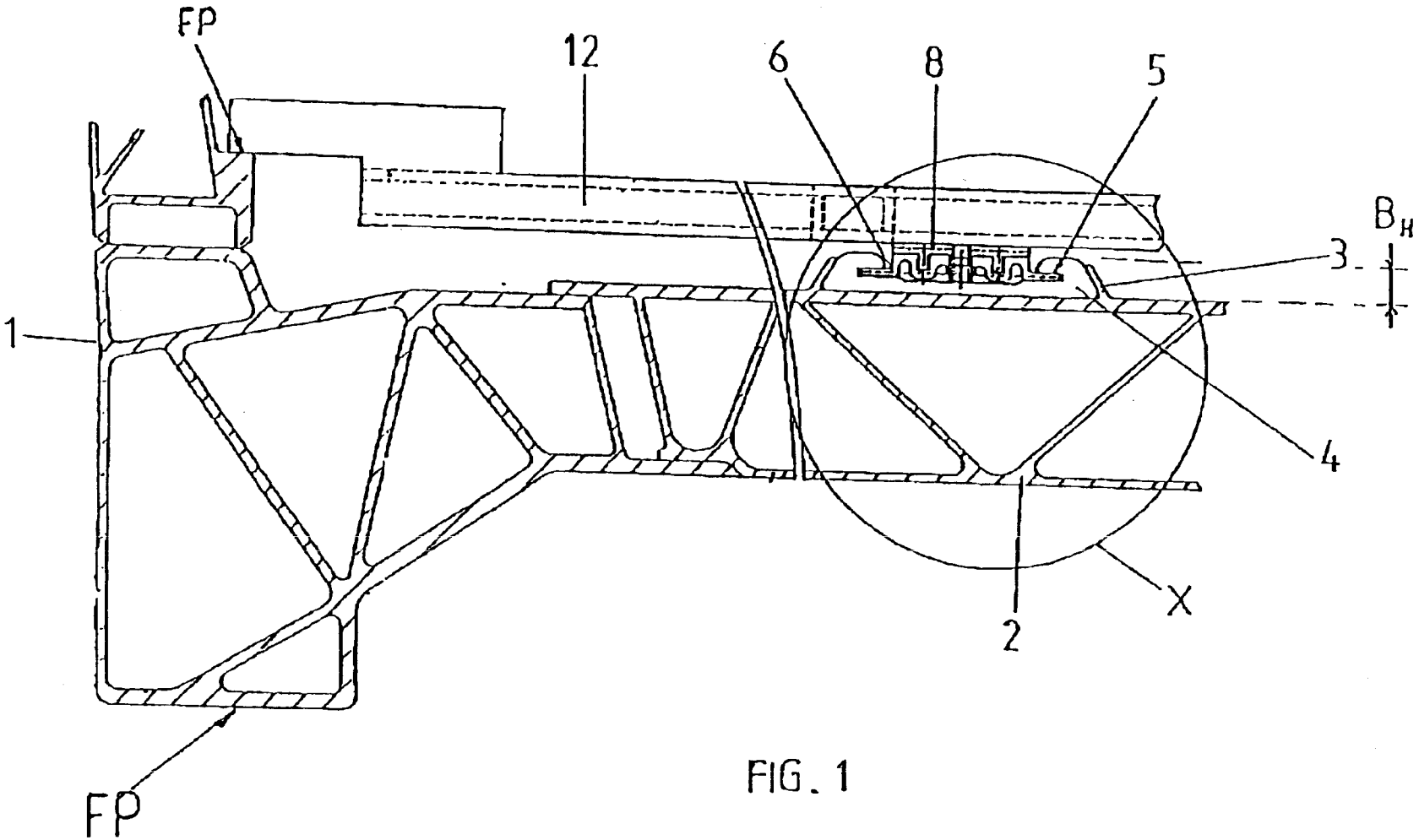
FIG. 1 is a schematic diagram of the floor claimed by the invention.

FIG. 1 is a schematic illustration of the floor. On the longitudinal girders 1 of the car body is mounted a bottom profile plate 2 that is composed of multiple-chamber profiles. In the longitudinal direction, the bottom profile plate 2 has projecting retaining webs in which respective short elastic profile battens 4, which can be 200 mm long, for example, are retained in the longitudinal direction by means of a positive fit. The profile battens 4 are made of rubber and are realized so that each two recesses 5 in the rubber body opposite each other in a plane each hold a rigid retaining profile 6.

The retaining profile 6 is made of metal, preferably aluminum, has a flat profile and for its part has two bearing surfaces F which are separated from each other by a recess 13. The recess 13 is located centrally and is depressed in the retaining profile 6 and preferably holds a blind rivet nut 16 for the subsequent bolting of the floor plates 12. For this purpose, there are transverse slots 17 provided in the floor plates 12.

Worked into the retaining profile 6 are blind holes 7, which run vertically with respect to the bearing surfaces F. The retaining profile 6 is inserted into the recesses 5 and must be retained with a positive fit manner so that it can move in the longitudinal direction. When it is inserted, the bearing surfaces F of the retaining profile 6 terminate appropriately at the height $B_H$ of the profile batten 4, so that the retaining profile does not exceed the height $B_H$ of the profile batten 4. By replacing the retaining profile 6, the floor height can be set higher or lower while retaining the rest of the superstructure. Rubber spacers 8 are inserted with a positive fit into the blind holes 7 of the retaining profile 6. The spacer 8 has an plug-in extension 10 for this purpose, the diameter of which is adapted to the diameter of the blind hole 7 and guarantees a secure seating in the blind hole 7. The plug-in extension 10 makes a gradual T-shaped transition into a crosshead 9, which is appropriately adapted to the bearing surface F.

Figure 2:
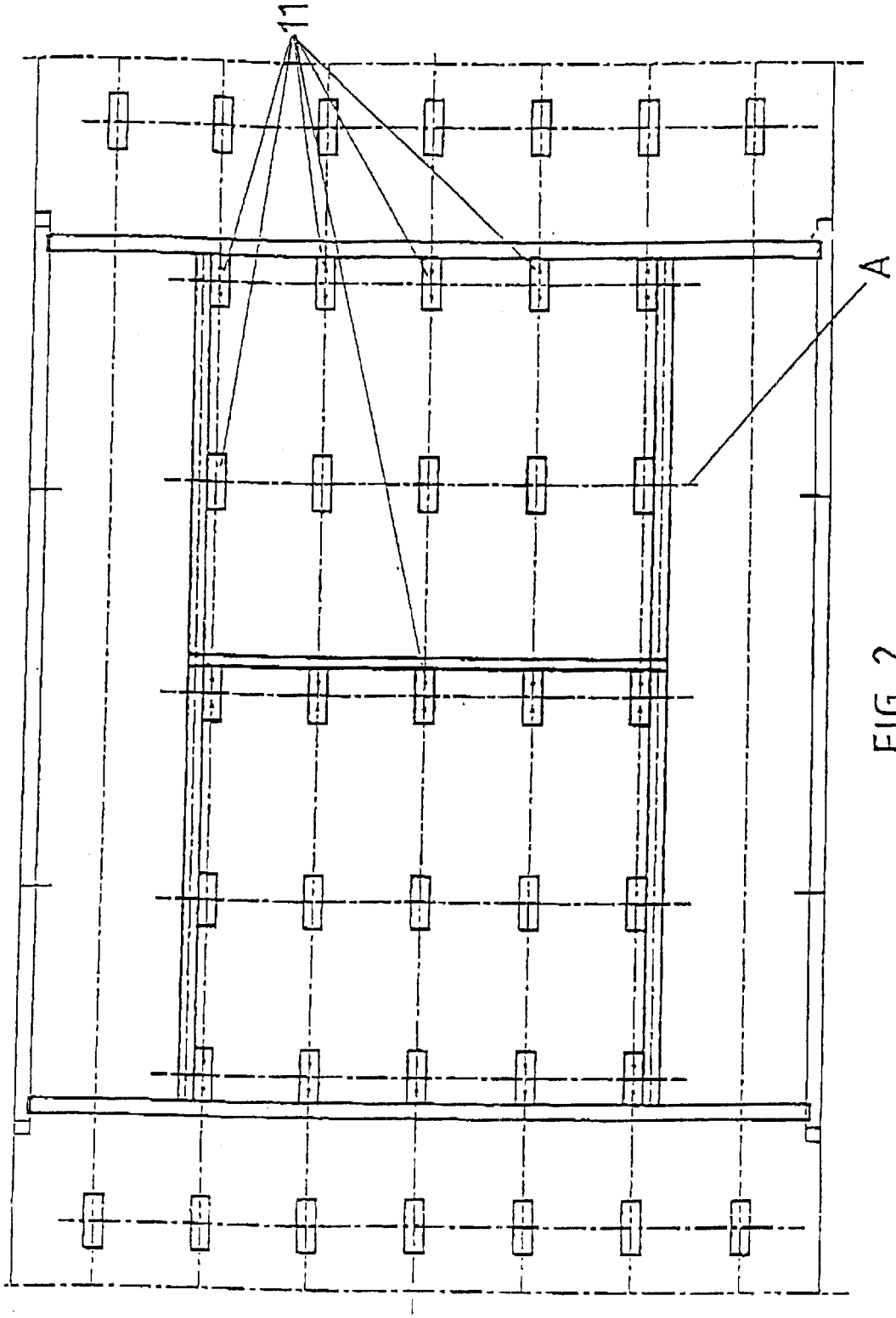
FIG. 2 is a plan view from overhead of the floor profile provided with bearings.

FIG. 2 is a detail of a bottom profile plate of a car body in a plan view from overhead. The retaining webs 3 of the bottom profile plate 2 lie next to one another and are separated so that they form an alignment A with one another in the longitudinal direction. As noted above, the webs 3 retain the rubber profile batten 4 so that the latter can move, and the rubber profile batten for its part holds the retaining profile 6 so that the retaining profile 6 with the spacers 8 can move longitudinally. The webs 3, profile batten 4, retaining profile 6 and spacers 8 together form the bearings 11. The floor 12 that is subsequently constructed is supported on these bearings 11.

As a result of the manufacturing tolerances in the floor area of the car body manufacture, the individual bearings 11 are at different levels $H_N$ both in the longitudinal direction and in the transverse direction.

Figure 3:
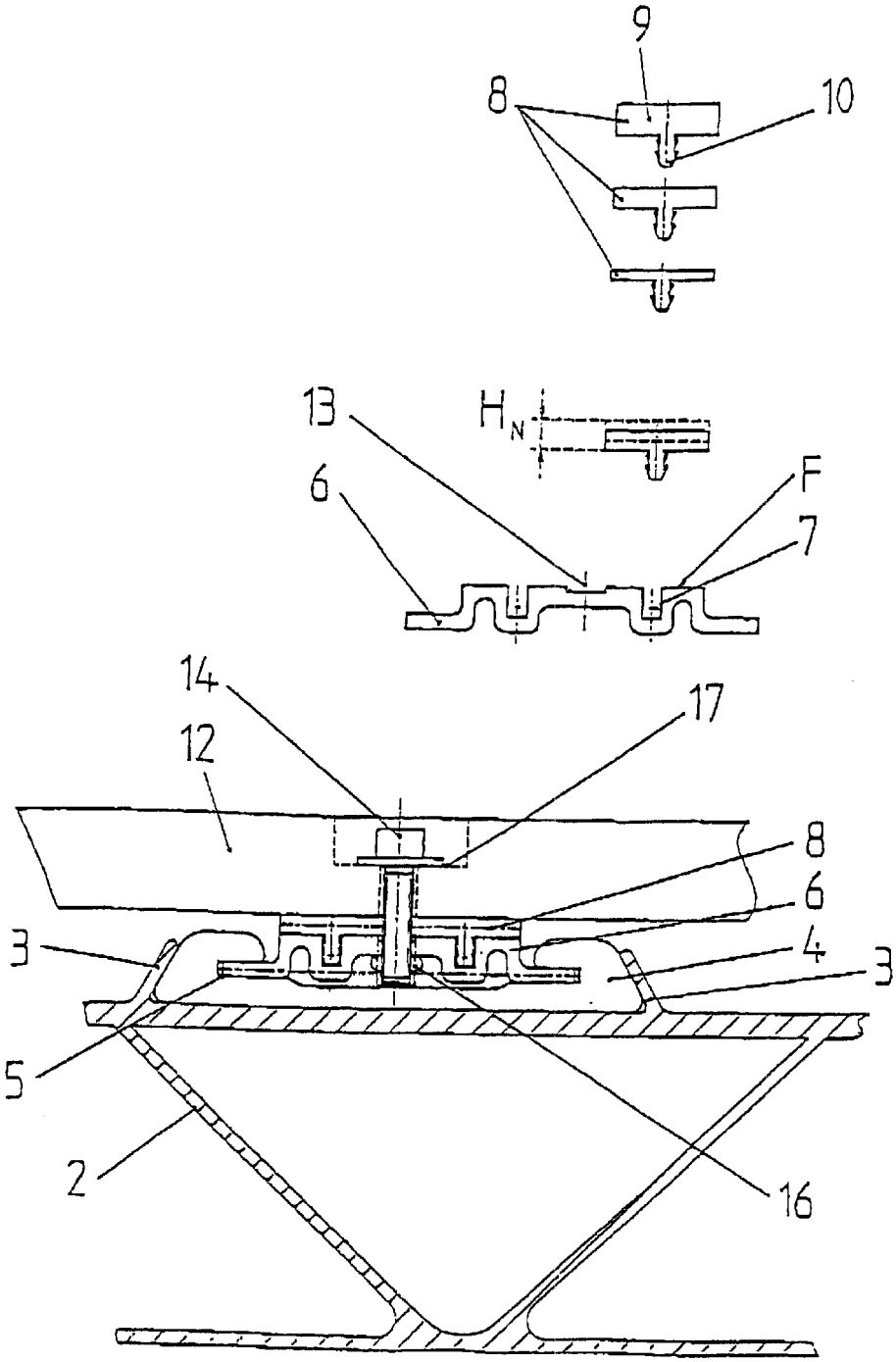
FIG. 3 is a detail X with a retaining profile and spacer of different thickness.

To level out this difference in the vertical dimension $H_N$ for the floor to be constructed on top of them, the spacers 8, as shown in FIG. 3, have crossheads 9 of different thicknesses that equalize the manufacturing and construction tolerances. For this purpose, starting from a fixed reference point FP (See FIG. 1), which is appropriately defined on a longitudinal girder 1, the vertical level $H_N$ is determined for each bearing 11 in the longitudinal and transverse directions. The spacers 8 with the correspondingly determined thicknesses are inserted into the crossheads 9 with their plug-in extensions 10 into the blind holes 7 of the retaining profile 6. The result is a leveled reference plane for the construction of the floor. This flat reference plane is an essential prerequisite for a continuously flat floor as the base for all of the internal fittings of the passenger compartments.

The number of bearings 11 to be installed is determined by the load or sag of the bottom profile pate and of the floor 12.

The rubber of the profile batten 4 and the rubber of the spacers 8 have different Shore hardness values. This difference in hardness ensures a particularly effective damping of sound and vibrations between the components.

Figure 4:
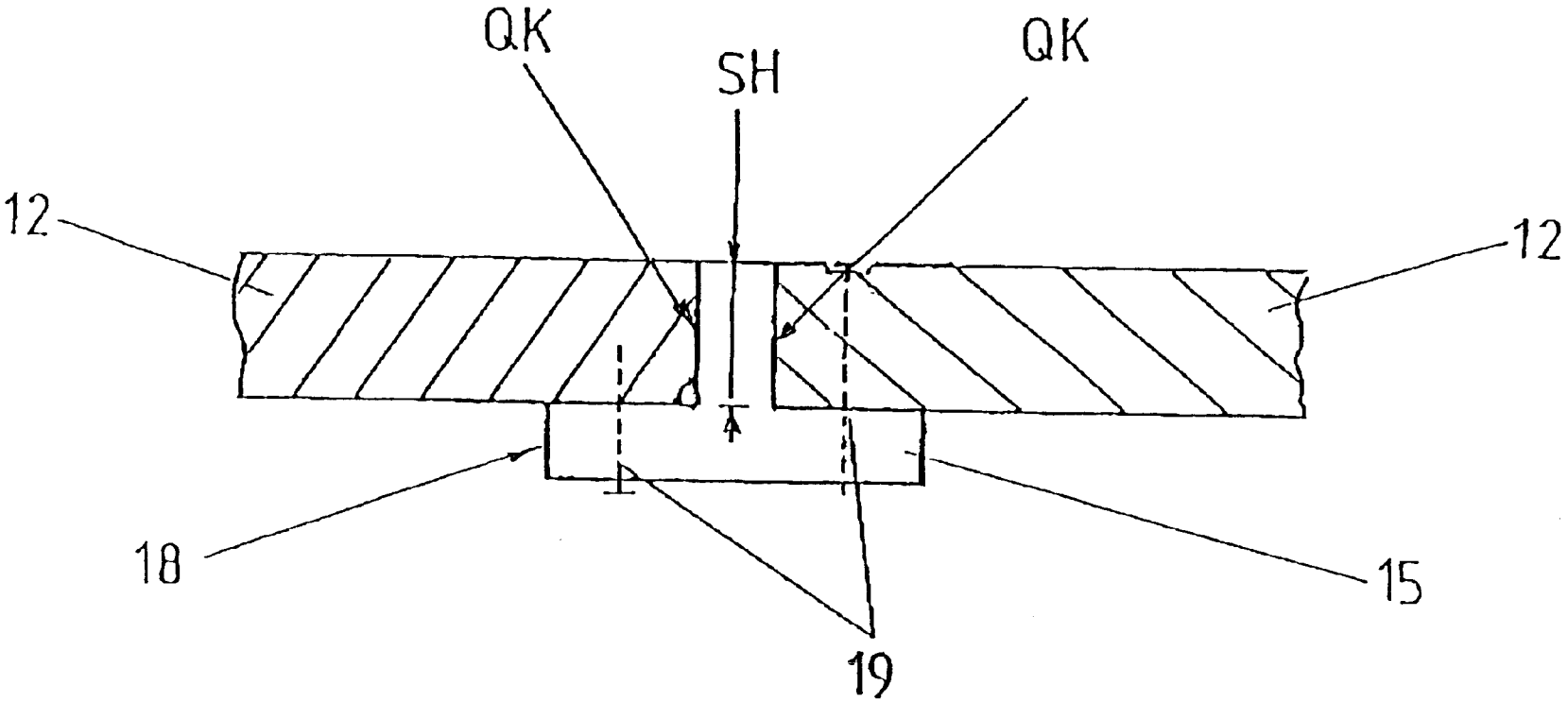
FIG. 4 is a section through the connection of the floor plates at their transverse edges.

FIG. 4 is a sectional drawing that shows two floor plates 12, which can be made of wood, for example, and are reinforced and connected to each other along the transverse plate abutments by a T-profile 15 which is made of aluminum. The T-profile 15 is inserted between the abutting ends of the floor plates so that an underside of each floor plate 12 comes to lie on the inside of the crosshead 18. The inner web height SH of the T-profile 15 is equal to the thickness of the floor plate 12 and thereby forms a continuous, flat connection of the floor plates to one another and reinforces them. The T-profile 15 is pre-installed on a transverse edge QK of the floor plate 12 and is placed on the bearing 11. The other floor plate 12 is laid on the other part of the crosshead 18 and is fastened to it by connection means 19, which can be bolts, for example.

Nomenclature

1 Longitudinal girder
2 Bottom profile plate
3 Retaining web
4 Profile batten
5 Rrecesses in 4
6 Retaining profile
7 Blind hole
8 Spacer
9 Crosshead of 8
10 Plug-in extension of 8
11 Bearings
12 Floor plate
13 Central recess in 6
14 Connecting element
15 T-profile
16 Blind rivet nut
17 Bransverse slot
18 Crosshead of 15
19 Connecting means, bolt
A Alignment of the bearings
$B_H$ Height of 4
F Bearing surface
$H_N$ Vertical level of the bearings
QK Transverse edge
SH Inner web height of 15
FP Fixed reference point

What is claimed is:

1. Floor for vehicles, in particular railway vehicles for transporting passengers, with a rigid bottom profile plate on which profile battens (4) that are elastic in the longitudinal direction and have recesses (5) are clamped as an isolation profile in projecting retaining webs (3) so that they can move in the longitudinal direction, whereby a rigid retaining profile (6) is fixed in the recesses so that it can move longitudinally, and with floor plates that are laid in the transverse direction with respect to the longitudinal direction of the vehicle, whereby the transverse edges of the floor plates are connected to one another, characterized by the fact that the retaining profile (6) is realized in the form of a profile in which there is a recess (13) to receive a connecting element (14) and at least one blind hole (7), in which an elastic spacer (8) is engaged by means of a plug-in extension (10) to equalize any differences in level between the floor plate and the bottom profile plate in a positive-fitting manner, whereby the positive fit between the blind hole (7) and the plug-in extension (10) is oriented perpendicular to the positive-fit connection between the profile batten (4) and the retaining profile (6).

2. Floor as claimed in claim 1, characterized by the fact that the profile batten (4) and the spacer (8) are made of rubbers that have different Shore hardness values.

3. Floor as claimed in claim 1, characterized by the fact that the retaining profile (6) preferably has a height that is approximately equal to the height of the profile batten (4).

4. Floor as claimed in claim 1, characterized by the fact that different floor heights can be set in different vehicles by replacing the retaining profile (6).

5. Floor as claimed in claim 1, characterized by the fact that the spacer (8) has a crosshead (9) which has a different thickness corresponding to the difference in height ($H_N$) to be equalized.

6. Floor as claimed in claim 1, characterized by the fact that the floor plates (12) are connected at the transverse edges (QK) by a T-profile (15).

7. Floor as claimed in claim 1, characterized by the fact that the floor plates (12) have T-shaped terminal edges at the transverse edges (QK).

8. Floor as claimed in claim 1, characterized by the fact that the retaining profile (6) is made of aluminum, brass or plastic.

9. Floor as claimed in claim 1, characterized by the fact that the connecting element (14) in the retaining profile (6) is preferably a blind rivet nut.

10. Floor as claimed in claim 6, characterized by the fact that the T-profile (15) is fastened to each transverse edge (QK) of the floor plates so that the connected plates are in contact with their transverse edges against the center web of the profile (15), and are in reinforcing contact on both sides against the crosshead (17) of the profile (15).

11. Floor as claimed in claim 6, characterized by the fact that the T-profile is made of metal, preferably aluminum.

* * * * *

UNITED STATES PATENT AND TRADEMARK OFFICE

CERTIFICATE OF CORRECTION

PATENT NO. : 6,668,733 B1
DATED : December 30, 2003
INVENTOR(S) : Holger Martens et al.

It is certified that error appears in the above-identified patent and that said Letters Patent is hereby corrected as shown below:

Column 5,
Lines 2-25, Claim 1 should read:

1. A floor for vehicles, comprising:

a rigid bottom profile plate on which profile battens that are elastic in a longitudinal direction and have recesses are clamped as an isolation profile in projecting retaining webs so that they can move in the longitudinal direction;

a rigid retaining profile fixed in the recesses so that it can move longitudinally;

floor plates laid in a transverse direction with respect to the longitudinal direction of the vehicle, wherein the transverse edges of the floor plates are connected to one another, wherein the retaining profile is realized in the form of a profile in which there is a recess to receive a connecting element and at least one blind hole, in which an elastic spacer is engaged by means of a plug-in extension to equalize differences in level between the floor plate and the bottom profile plate in a positive-fitting manner, and wherein the positive fit between the blind hole and the plug-in extension is oriented perpendicular to the positive-fit connection between the profile batten and the retaining profile.

Lines 6-29, Claim 2 should read:

2. The floor as claimed in Claim 1, wherein the profile batten and the spacer are made of rubbers that have different Shore hardness values.

Lines 30-34, Claim 3 should read:

3. The floor as claimed in Claim 1, wherein the retaining profile has a height that is approximately equal to the height of the profile batten.

Lines 35-38, Claim 4 should read:

4. The floor as claimed in Claim 1, wherein different floor heights can be set in different vehicles by replacing the retaining profile.

Column 6,
Lines 2-6, Claim 5 should read:

5. The floor as claimed in Claim 1, wherein the spacer has a crosshead which has a different thickness corresponding to the difference in height to be equalized.

Lines 7-10, Claim 6 should read:

6. The floor as claimed in Claim 1, wherein the floor plates are connected at the transverse edges by a T-profile.

UNITED STATES PATENT AND TRADEMARK OFFICE

CERTIFICATE OF CORRECTION

PATENT NO. : 6,668,733 B1
DATED : December 30, 2003
INVENTOR(S) : Holger Martens et al.

It is certified that error appears in the above-identified patent and that said Letters Patent is hereby corrected as shown below:

Column 6 (cont'd),

Lines 11-15, Claim 7 should read:

7. The floor as claimed in Claim 1, wherein the floor plates have T-shaped terminal edges at the transverse edges.

Lines 16-19, Claim 8 should read:

8. The floor as claimed in Claim 1, wherein the retaining profile is made of aluminum, brass or plastic.

Lines 20-24, Claim 9 should read:

9. The floor as claimed in Claim 1, wherein the connecting element in the retaining profile is a blind rivet nut.

Lines 25-33, Claim 10 should read:

10. The floor as claimed in Claim 6, wherein the T-profile is fastened to each transverse edge of the floor plates so that the connected plates are in contact with their transverse edges against the center web of the profile, and are in reinforcing contact on both sides against the crosshead of the profile.

Lines 34-36, Claim 11 should read:

11. The floor as claimed in Claim 6, wherein the T-profile is made of metal.

Signed and Sealed this

Twenty-seventh Day of December, 2005

JON W. DUDAS
*Director of the United States Patent and Trademark Office*